United States Patent [19]

Stoddard et al.

[11] Patent Number: 5,016,761

[45] Date of Patent: May 21, 1991

[54] TRANSPORTABLE DISPLAY MODULE

[75] Inventors: David C. F. Stoddard; James D. Robertson, both of Atlanta; William S. Spamer, Roswell; James Hanna, Athens; Randall E. Bailey, Alpharetta; Dennis E. Parham, Social Circle, all of Ga.

[73] Assignee: The Mead Corporation, Dayton, Ohio

[21] Appl. No.: 362,731

[22] Filed: Jun. 7, 1989

[51] Int. Cl.[5] ..... A67F 5/00

[52] U.S. Cl. ..... 211/59.4; 211/74; 211/194; 108/55.1; 206/497; 206/597; 206/821

[58] Field of Search ..... 211/59.4, 74, 194, 188; 108/55.1, 55.3, 53.5, 51.1; 206/432, 427, 497, 392, 597, 599

[56] References Cited

U.S. PATENT DOCUMENTS

| | | | |
|---|---|---|---|
| 4,339,040 | 7/1982 | Peil et al. | 108/55.1 X |
| 4,567,981 | 2/1986 | Headon | 206/597 X |
| 4,653,651 | 3/1987 | Flum | 211/59.4 |
| 4,667,823 | 5/1987 | Wolfe et al. | 206/821 X |
| 4,688,714 | 8/1987 | Padovani | 206/497 X |
| 4,735,321 | 4/1988 | Day | 211/59.4 X |
| 4,801,024 | 1/1989 | Flum et al. | 211/59.4 |

*Primary Examiner*—Robert W. Gibson, Jr.
*Attorney, Agent, or Firm*—Thomas A. Boshinski

[57] ABSTRACT

In a transportable display module for a plurality of containers, a base member supports a first layer of containers, and a plurality of layers each comprising a tier sheet alternate with a plurality of layers of containers. The tier sheets are identical, with a circumferential skirt surrounding each tier sheet. The top surface of each tier sheet includes an array of container bottom receiving recesses. The bottom surface includes an array of container top receiving recesses disposed concentric with the bottom receiving recesses. Each tier sheet has about its circumferential skirt an outwardly extending flange, and the module is surrounded by plastic film. The base member is a single piece including an upper portion having an additional one of the tier sheets, with a lower portion affixed thereto and including a plurality of supporting legs. Overlay sheets provide for loading other forms of containers, and a cap sheet enabling stacking of multiple modules is disclosed.

13 Claims, 3 Drawing Sheets

TRANSPORTABLE DISPLAY MODULE

BACKGROUND OF THE INVENTION

The present invention relates generally to display devices for use in merchandising products and, more particularly, to such a display device for beverage containers wherein the device and containers may be assembled at one location and transported to a second location for display.

Various forms of display devices have been used for merchandising a variety of products. Many of these displays have been specifically intended for beverage containers, particularly soft drinks packaged in bottles. For examples of such display devices, see generally U.S. Pat. Nos. 3,983,822 of Suttles and 4,379,431 of Clement.

While the use of attractive product displays can enhance product sales, the display devices nonetheless represent an inconvenience to the beverage bottler, wholesaler and/or retailer. The display device is typically shipped from the manufacturer in a disassembled condition and must first be erected at the point of display. Next, product containers must be loaded onto the display device. Once the stock of containers has been depleted, additional containers must be loaded. Further, arrangements must be made for transporting relatively large quantities of beverage containers to the location of the display.

To overcome these disadvantages, it has previously been proposed to provide a transportable display module for beverage containers, particularly for blow molded two liter bottles. Such a module may be erected and loaded by the bottler or wholesaler and transported in an assembled and loaded condition directly to the point of display. Such modules include alternating layers of beverage containers and container supporting trays or tier sheets. A base is provided beneath the lowermost layer of containers, and a cover sheet is positioned over the uppermost layer. The entire module is then secured with banding straps or the like. Examples of such display modules may be seen by reference to U.S. Pat. No. 4,735,321 of Day and U.S. Pat. No. 4,801,026 of Flum et al.

Such known display modules are not without disadvantages, however. For example, a relatively high number of different parts are required to provide the base, formed as a two-piece construction, the tier sheets and cover sheet. Further, securing of the module by banding straps is relatively time consuming and makes automatic loading operations difficult. Further, tightening of the straps may introduce unwanted leaning tendencies into the assembled module, possibly introducing instabilities into the module. Additionally, the known modules make no provisions to accommodate beverage containers other than the relatively large bottles for which they are designed, nor is any provision made for warehousing the modules by vertically stacking them.

What is needed, therefore, is an improved transportable display module for beverage containers which overcomes the various disadvantages noted above. Such a module should be stable and secure when assembled, use a relatively small number of individual parts, and be relatively simple to manufacture, load and transport.

SUMMARY OF THE INVENTION

The present invention provides a transportable display module for a plurality of containers, wherein each container includes a top and a bottom. The display module includes a base member supporting a first layer of containers, and a plurality of layers each comprising a tier sheet alternating with a plurality of layers of containers. Each of the tier sheets is identical and has a top surface, a bottom surface, and a circumferential skirt surrounding the tier sheet. The top surface of each tier sheet includes an array of container bottom receiving recesses. The bottom surface includes an array of container top receiving recesses disposed concentric with the bottom receiving recesses.

According to one aspect of the invention, each of the tier sheets within the module has formed about its circumferential skirt an outwardly extending flange. The module is further surrounded by a wrapper of plastic film. The outwardly extending flange is preferably disposed at the lowermost portion of the skirt to allow more secure engagement of the module by the film, and to strengthen the skirt to prevent distortions which might otherwise be introduced during stretch-wrapping of the film. Further, the tier sheet may be generally quadrangular in shape, defining four corners therefor, with each of the corners being rounded.

According to a second aspect of the invention, the base member includes an upper portion having an additional one of the tier sheets, with a lower portion affixed thereto and including a plurality of supporting legs. A reinforcing structure is located along the lower portion between the legs for enabling the display module to be supported by the base member. Preferably, the lower portion may be formed as a single sheet, with the legs being each formed as a downwardly depending hollow cup, and with the reinforcing structure formed into the single sheet. Further, a tubular reinforcing means may be disposed in an upright orientation within each of the cups.

According to a further form of the invention, the module may include a plurality of overlay sheets, each configured for and disposed on top of one of the tier sheets to define a relatively flat surface for the placement of containers thereon which are shaped differently from those corresponding to the bottom receiving recesses of the tier sheets. The overlay sheet may include an upwardly extending flange disposed around the periphery of the overlay sheet for retaining on the overlay sheet any containers positioned thereon. A relatively short overlay skirt may extend downwardly from the flange to overlay the tier sheet skirt for retaining the overlay sheet on the tier sheet.

According to a still further form of the invention, a cap member may be positioned on top of the uppermost one of the layers of containers. The cap member is substantially the same size as the tier sheets and includes a central portion having a downwardly depending cap skirt surrounding the central portion. The central portion further has formed therein means for supporting the legs of a base member arranged in a manner identical to the legs of the display module, whereby a second display module may be stacked thereon.

Accordingly, it is an object of the present invention to provide a display module for beverage containers which may be assembled and loaded in a first location and transported to a second location for display; to provide such a module which is appropriate for loading by mechanized means; to provide such a module which is stable when in a loaded condition; to provide such a module which is stackable for warehousing purposes; and to provide such a module wherein the parts thereof may be easily handled when emptied of beverage containers.

Other objects and advantages of the present invention will be apparent from the following description, the accompanying drawings and the appended claims.

DETAILED DESCRIPTION OF THE PREFERRED EMBODIMENTS

Figure 1:
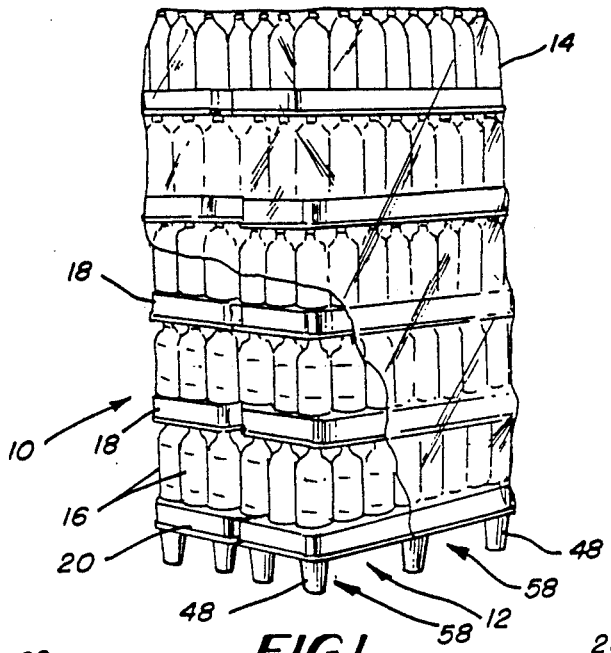
FIG. 1 is a perspective view of a pair of display modules assembled and wrapped with a plastic film.

Referring now to FIG. 1, a pair of transportable display modules 10 and 12 in accordance with the present invention are shown. Modules 10 and 12 are positioned in side-by-side relationship and are surrounded by a plastic film 14, preferably secured by stretch-wrapping, which is shown partially broken away to expose the modules 10 and 12. Each module 10 and 12 supports a plurality of beverage containers, such as bottles 16. Each module accommodates a plurality of layers of bottles(five shown), with each individual layer formed in the depicted embodiment of three rows of eight bottles each ($3\times8$). Located between each layer of bottles 16 is a tier sheet 18, the tier sheet 18 adapted to receive the bottoms of bottles 16 along its top surface, and to engage the tops of the bottles of the underlying layer along its bottom surface. Details of the individual tier sheets 18 will be described in greater detail below. Additionally, a base member 20 supports the entire module 10 or 12, the base member 20 receiving the bottommost layer of bottles 16 along its top surface, and providing means for supporting the module along its bottom.

Figure 2:
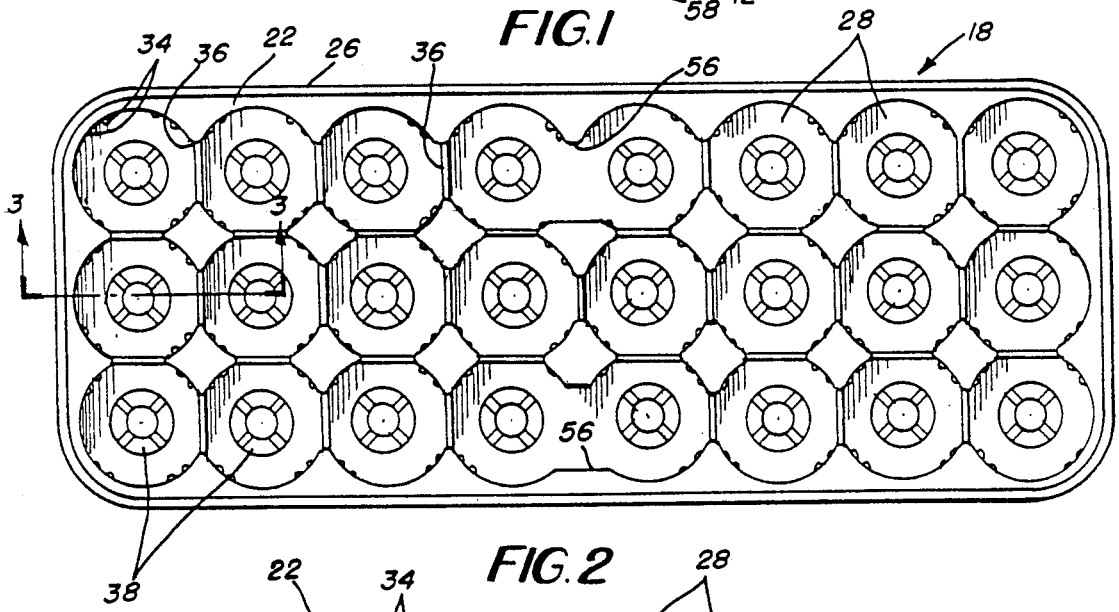
FIG. 2 is a top plan view of a tier sheet used in the display module.
Figure 3:
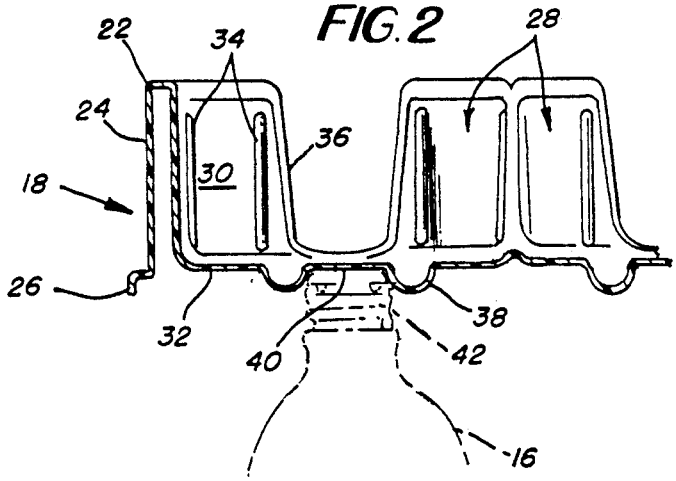
FIG. 3 is a section taken along line 3—3 of FIG. 2.

Details of an individual tier sheet 18 may be seen by reference to FIGS. 2 and 3. Each tier sheet includes an outer peripheral edge 22, from which downwardly depends a skirt portion 24. The skirt portion 24 extends about the entire periphery of tier sheet 18 and, in a preferred embodiment, the corners of the individual tier sheet 18 around it. Located at the lowermost portion of skirt 18 is an outwardly extending flange 26. This flange 26 provides a means for more secure engagement of the stretch-wrapped film with the module, and strengthens the skirt portion 24 against distortion during stretch wrapping.

Tier sheet 18 is formed as a single molded sheet of thermoplastic material. Defined along the upper surface of tier sheet 18 is an array comprising a plurality of bottle bottom receiving recesses 28. Such recesses are defined by substantially vertical side walls 30 and a recessed floor 32. Located along sides 30 are upstanding ribs 34 which serve both to reinforce the structure and to provide a tightening or securing effect to bottles placed within recesses 28. Side walls 30 are further configured so as to define an opening 36 therebetween interconnecting adjacent recesses 28.

Formed into the bottom surface 32 of each recess 28 is a circular trough 38. When viewed from the under side of the tier sheet 18, trough 38 forms instead a projection 38 defining therebetween a recess 40 which is sized to receive the cap 42 of an underlying bottle 16. Thus, the bottom surface of tier sheet 18 effectively defines a plurality of such bottle top receiving recesses 40.

Figure 4:
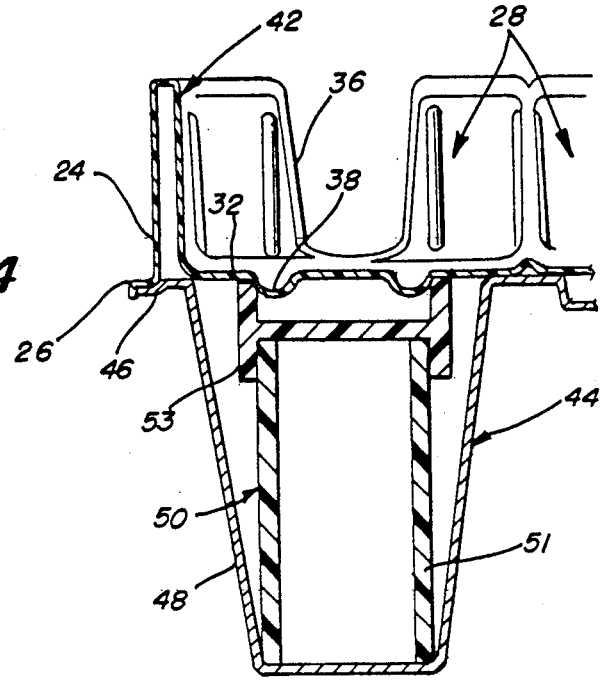
FIG. 4 is a vertical cross section similar to FIG. 3, but showing a base member for the display module.
Figure 6:
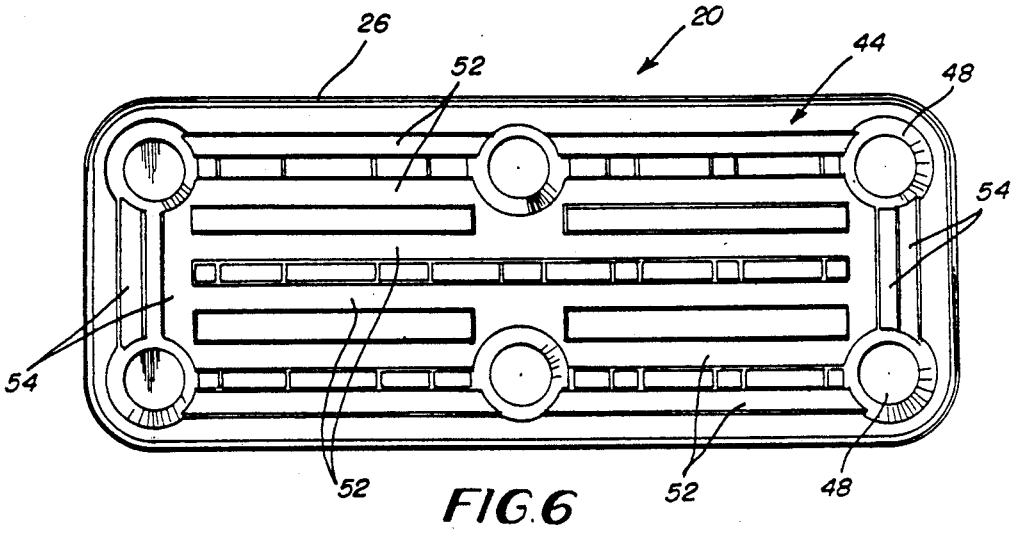
FIG. 6 is a bottom view of a base member for the display module.

Base member 20 can be seen in detail by referring to FIGS. 4 and 6. From FIG. 4, it will be recognized that base member 20 includes a top portion 42 which is essentially identical to a tier sheet 18 as shown in FIGS. 2 and 3. Similar parts of upper portion 42 are identified by numbers identical to those used in connection with tier sheets 18. A plurality of bottle bottom receiving recesses 28 secures the bottoms of the lowermost layer of bottles in the module.

Base member 20 additionally includes a lower portion 44, preferably molded from a thermoplastic material, and is secured to top portion 42 by welding, gluing or the like. Bottom portion 44 includes an outer peripheral flange 46 which cooperates with flange 26 located at the bottom of skirt 24 of upper portion 42 to properly locate upper and lower portions 42 and 44, as well as to provide locations for joining the portions together. Additionally, cup-like projections 48 depend downwardly to define a plurality of supporting legs. Tubular reinforcing members 50, which in one embodiment may simply be sections of polyvinyl chloride tubing 51 attached to coupling 53 or the like, are placed within projections 48. These reinforcing members 50 contact the overlying bottom surface 32 of recess 28 surrounding trough 38 to provide additional support and reinforcement for base member 20, particularly when loaded with beverage containers.

The underside of base member 20, showing the entire bottom portion 44, can be seen by reference to FIG. 6. The six legs 48 are shown, and by comparing FIG. 2 with FIG. 6, it can further be seen that a pair of reinforcing ribs 52 is located beneath each row of the array of recesses 28 used to support bottles when the display module is loaded. Additional pairs of reinforcing ribs 54 extend transversely across the lower portion of base member 20, cooperating with reinforcing ribs 52.

By referring back to FIG. 1, it can be seen that the display module provides a unitary base member 20 and a plurality of tier sheets 18 used to support the bottles 16. By using a unitary base member 20, the number of separate parts contained within a display module may be minimized. Further, each of the tier sheets 18 is nestable with other tier sheets, so that once the display module has been emptied of product, the portions may simply be stacked for return to the beverage bottler. The tier sheets 18 are further stackable on base member 20 due to the identical configuration of the top portion of base member 20 with one of the tier sheets 18.

A plurality of display modules may be stacked atop each other when empty. Referring again to FIG. 2, it can be seen that a base member 20 may be positioned on a tier sheet 18. The corner legs 48 each fit within the corner bottom receiving recess. For the center legs 48, it will be noted that the recesses 28 located at the center of the outer rows of such recesses have their side walls 30 cut away to define enlarged openings 56 therebetween into which the center legs 48 may be placed.

It should be noted that legs 48 are positioned so as to provide spaced openings 58 (see FIG. 1) therebetween into which the forks of a lift truck or other device may be inserted for transporting the assembled module 10 when loaded. Further, it will be appreciated that the size of the individual tier sheets may be varied from the 3×8 configuration shown in the drawings. For example, a 6×8 configuration may be used, wherein an identical number of bottles may be accommodated as in the two modules 10 shown in FIG. 1. The exact size of the individual tier sheets 18 and base member is limited only by the amount of product desired to be loaded and the size and bulk of a loaded display module which may be transported. Of course, modifications to the number and location of legs 48 may be required as the size of the module is varied.

Figure 5:
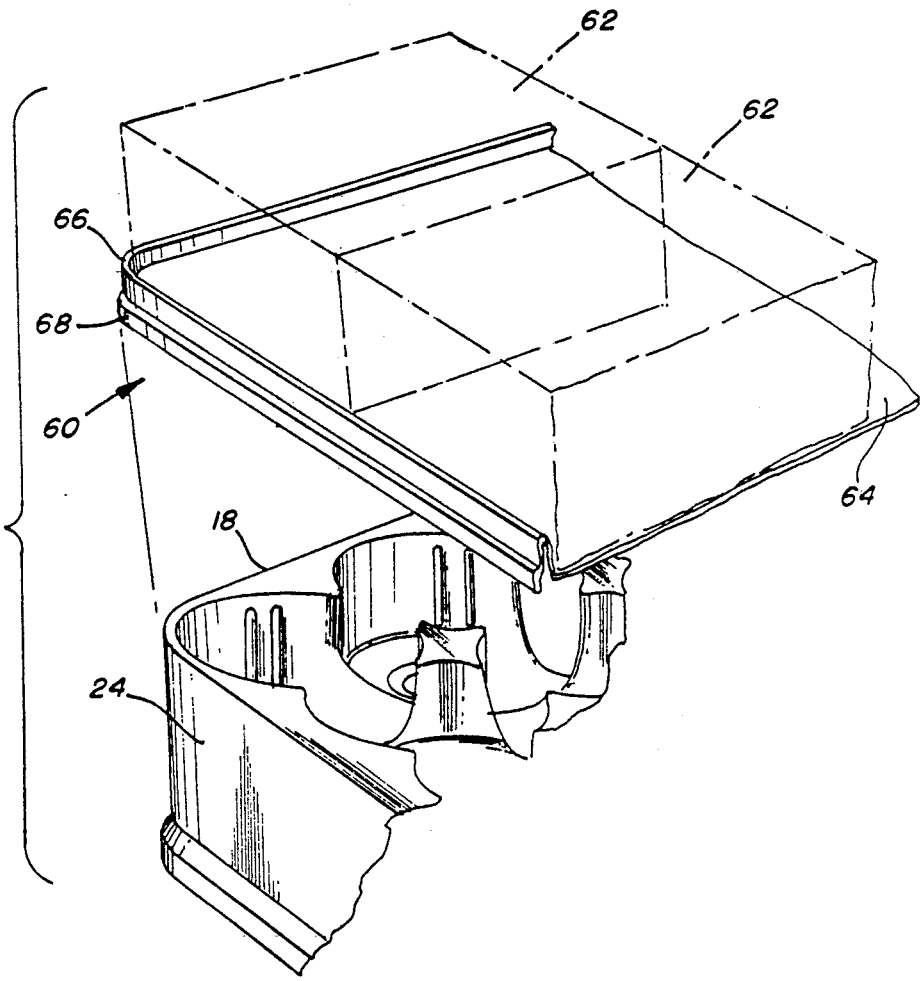
FIG. 5 is a partial perspective view of a tier sheet illustrating placement of an overlay sheet thereon.

The display module disclosed herein may be modified for use with containers other than bottles of one particular size. Referring now to FIG. 5, it can be seen that an overlay sheet 60 is provided which can accommodate other product containers, such as multiple can or bottle cartons 62 or individual cans or bottles (not shown). Overlay 60 includes a generally planar product support surface 64, surrounded by an upwardly extending flange 66 which retains the product container 62 in place on support surface 64. An overlay skirt 68 extends downwardly from flange 66 and is fittable over the outer periphery of a tier sheet 18 and extends partially down along the skirt 24 of tier sheet 18. This then secures the overlay sheet 60 into position.

It will be recognized that a similar overlay sheet 60 may be positioned on a base member 20, since the upper portion of such base member is identical to a tier sheet 18. However, it will also be recognized that it is possible to eliminate the upper portion of base member 20 and substitute therefor an upper portion similar in construction to overlay sheet 60. This will provide a base member which is particularly adapted for the alternative product and, indeed, is limited to use with such product.

Loading of such a display module will be similar to that shown in FIG. 1 and described in connection with the primary embodiment. Tier sheets 18 with overlay sheets 60 positioned thereon will be interleaved with layers of product containers. In the case of product containers in the form of cartons, whereby relatively stable stacking may be achieved, it may be possible to include two or more layers of product containers between each tier sheet/overlay sheet combination.

Figure 7:
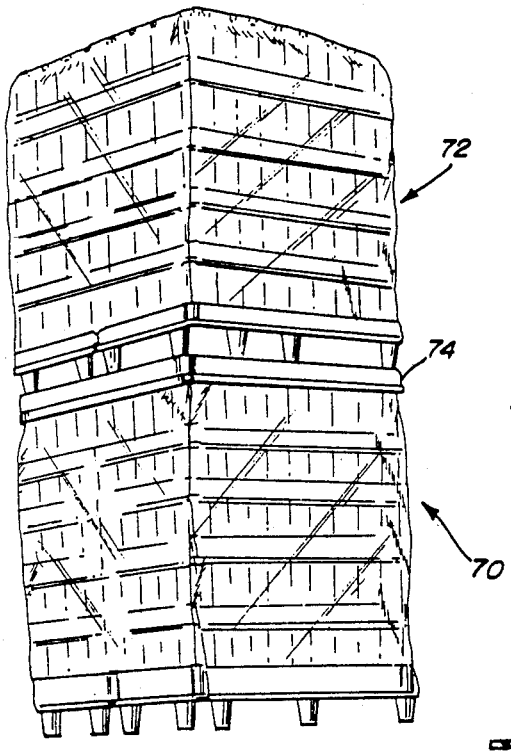
FIG. 7 is a perspective view of assembled display modules in a stacked condition.

A further feature of the present invention can be seen by reference to FIG. 7. Loaded and wrapped display modules 10 may be stacked atop each other as shown by lower display module 70 and upper display module 72. While such stacking would not generally be carried out in a retail environment, it may be desirable in a warehouse situation to conserve storage space. In order to facilitate such stacking, a top cap member 74 is positioned on top the lower module 70 to provide stable support for the upper module 72. This cap member 74 may be applied to lower module 70 either before or after wrapping of the module with film.

Figure 8:
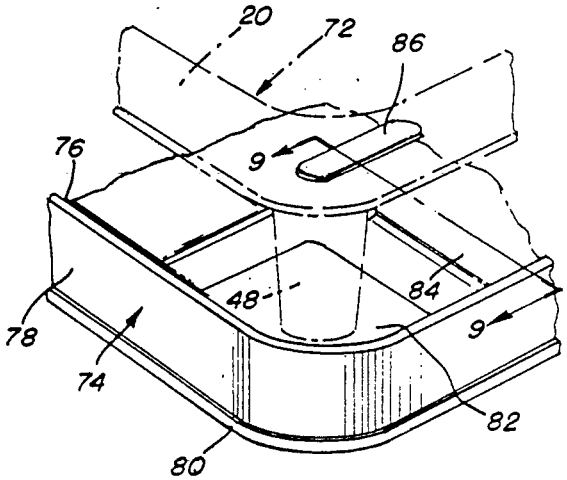
FIG. 8 is a partial perspective view of a cap member showing placement thereon of a base member of a display module.
Figure 9:
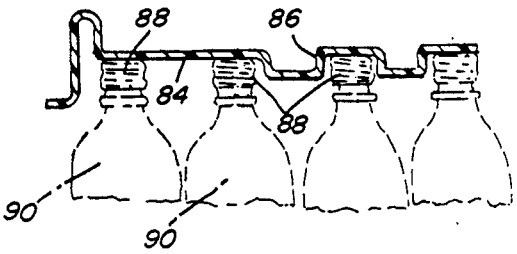
FIG. 9 is a vertical cross section taken along line 9—9 of FIG. 8.

The cap member 74 may be seen in greater detail by reference to FIG. 8. The cap member includes an upwardly extending peripheral flange 76 and a downwardly extending cap skirt 78, the skirt 78 having an outwardly extending flange 80 located at its bottom edge. Flanges 76 and 80 and skirt 78 are provided to impart rigidity to the cap member 74. Along the upper surface of cap member 74 is defined a plurality of lands 82 which provide plainer surfaces for positioning of legs 48 of base member 20 of upper display module 72. Further projections 84 and 86 can also be seen formed on the top surface of cap member 74. Such projections 84 and 86 provide additional reinforcement to cap 74 and, importantly, provide means for retaining the caps 88 of underlying bottles 90. Securing of such bottles against movement is necessary to impart stability to the stacked display modules.

While the forms of apparatus described herein constitute preferred embodiments of the present invention, it will be recognized that changes may be made therein without departing from the scope of the invention which is defined in the appended claims.

What is claimed is:

1. A transportable display module for a plurality of containers each having a top and a bottom, comprising:

a base member supporting a first layer of containers;

a plurality of layers each comprising a tier sheet alternating with a plurality of containers;

each of said tier sheets being identical and having a top surface, a bottom surface, and a circumferential skirt surrounding substantially the complete periphery of said tier sheet;

said top surface having an array of container bottom receiving recesses, and said bottom surface having an array of container top receiving recesses disposed concentric with said bottom receiving recesses;

each of said tier sheets having formed about said circumferential skirt an outwardly-extending flange;

said module further being surrounded by a wrapper of plastic film, said plastic film being placed in direct contact with said circumferential skirts about substantially the complete periphery of said tier sheets.

2. The display module of claim 1, wherein said outwardly extending flange is disposed at the lowermost portion of said skirt.

3. The display module of claim 2, wherein said plastic film is a stretch-wrap film.

4. The display module of claim 1, wherein said tier sheet is generally quadrangular in shape, defining four corners therefor, and wherein each of said corners is rounded.

5. A transportable display module for a plurality of containers each having a top and a bottom, comprising:

a base member supporting a first layer of containers;

a plurality of layers each comprising a tier sheet alternating with a plurality of layers of containers;

each of said tier sheets being identical and having a top surface, a bottom surface, and a circumferential skirt surrounding said tier sheet;

said top surface having an array of container bottom receiving recesses, and said bottom surface having an array of container top receiving recesses disposed concentric with said bottom receiving recesses;

said base member including an upper portion comprising an addition one of said tier sheets, and a lower portion affixed thereto and including a plurality of supporting legs and reinforcing structure located along said lower portion between said legs for enabling said display module to be supported by said base member;

said lower portion being formed as a single sheet, said legs being each formed as a downwardly depending hollow cup and said reinforcing structure being formed into said single sheet.

6. The display module of claim 5, wherein said reinforcing structure includes at least one rib formed into said sheet to extend beneath each row of said array of said bottom receiving recesses defined into said one of said tier sheets affixed to said lower portion of said base member.

7. The display module of claim 5, said base member further including tubular reinforcing means disposed in an upright orientation within each of said cups.

8. A transportable display module for a plurality of containers each having a top and a bottom, comprising:

a base member supporting a first layer of containers;

a plurality of layers each comprising a tier sheet alternating with a plurality of layers of containers; each of said tier sheets being identical and having a top surface, a bottom surface, and a circumferential skirt surrounding said tier sheet;

said top surface having an array of container bottom receiving recesses, and said bottom surface having an array of container top receiving recesses disposed concentric with said bottom receiving recesses;

a plurality of overlay sheets, each configured for and disposed atop one of said tier sheets to define a relatively flat surface for the placement of containers thereon which are shaped differently from those corresponding to said bottom receiving recesses.

9. The display module of claim 8, each of said overlay sheets including an upwardly extending flange disposed about the periphery of said overlay sheet for retaining on aid overlay sheet containers placed thereon, and a relatively short overlay skirt extending downwardly from said flange to overlay said tier sheet skirt for retaining said overlay sheet on said tier sheet.

10. A transportable display module for a plurality of containers each having a top and a bottom, comprising:

a base member having a plurality of legs for said display module supporting a first layer of containers;

a plurality of layers each comprising a tier sheet alternating with a plurality of containers;

each of said tier sheets being identical and having a top surface, a bottom surface, and a circumferential skirt surrounding said tier sheet;

said top surface having an array of container bottom receiving recesses, and said bottom surface having an array of container top receiving recesses disposed concentric with said bottom receiving recesses;

a cap member positioned on top of the uppermost one of said layers of containers, said cap member being substantially the same size as said tier sheets and including a central portion having a downwardly depending cap skirt surrounding said central portion, said central portion further having formed therein means for supporting legs of another base member arranged in a manner identical to said legs of said display module, whereby a second display module may be stacked thereon.

11. The display module of claim 10, wherein said cap member further includes raised and lowered portions of said central portion for retaining the containers of said uppermost layer in relative position.

12. A transportable display module for a plurality of containers each having a top and a bottom, comprising:

a base member supporting a first layer of containers;

a plurality of layers each comprising a tier sheet alternating with a plurality of containers;

each of said tier sheets being identical and having a top surface, a bottom surface, and a circumferential skirt surrounding said tier sheet;

said top surface having an array of container bottom receiving recesses defining four corner recesses and parallel rows of said recesses, each row comprising an even number of said recesses, and said bottom surface having an array of container top receiving recesses disposed concentric with said bottom receiving recesses;

said base member including an upper portion having an upper surface identical to said upper surface of one of said tier sheets, and at least six downwardly-depending supporting legs arranged to underly each of said corner recesses and between the centermost ones of said recesses of the outermost rows;

said corner recesses being formed of a size to receive one of said legs into each of said corner recesses, said tier sheets being further formed with a portion between the centermost ones of said bottom receiving recesses of the outermost rows removed to receive therebetween one of said legs, whereby said tier sheets and said base member may be nested together when empties of said containers.

* * * * *